US007451970B2

(12) United States Patent
Kawata

(10) Patent No.: US 7,451,970 B2
(45) Date of Patent: Nov. 18, 2008

(54) SHEET FEEDING DEVICE WITH PLURAL SHEET FEEDING MEANS FEEDING IN OPPOSITE DIRECTIONS TO SHEET POST-PROCESSING SYSTEM

(75) Inventor: Wataru Kawata, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/263,977

(22) Filed: Nov. 2, 2005

(65) Prior Publication Data

US 2006/0061031 A1 Mar. 23, 2006

Related U.S. Application Data

(62) Division of application No. 10/660,583, filed on Sep. 12, 2003, now Pat. No. 6,976,672.

(30) Foreign Application Priority Data

Sep. 19, 2002 (JP) ..... 2002-273022

(51) Int. Cl.
*B65H 33/04* (2006.01)

(52) U.S. Cl. ..... 270/58.14; 270/58.22; 270/58.23; 271/9.11; 271/9.12; 271/9.13

(58) Field of Classification Search ..... 270/58.23, 270/58.24, 58.25, 58.22, 58.14, 58.31, 58.32; 271/9.11, 9.12, 9.13; 400/624; 399/393
See application file for complete search history.

(56) References Cited

U.S. PATENT DOCUMENTS

| | | | | |
|---|---|---|---|---|
| 5,158,276 | A | 10/1992 | Toma | 271/9.11 |
| 5,221,951 | A | 6/1993 | Sakamoto | 399/393 |
| 5,355,205 | A | 10/1994 | Toyama et al. | 399/14 |
| 5,621,501 | A | 4/1997 | Matsuo et al. | 355/75 |
| 5,730,535 | A | 3/1998 | Keller et al. | 400/605 |
| 5,911,414 | A | 6/1999 | Kato et al. | 270/58.07 |
| 6,145,826 | A | 11/2000 | Kawata | 270/58.28 |
| 6,237,910 | B1 | 5/2001 | Kawata | 271/213 |
| 6,264,189 | B1 | 7/2001 | Kawata | 271/176 |
| 6,371,471 | B1 | 4/2002 | Fukazu et al. | 270/58.09 |
| 6,505,829 | B2 | 1/2003 | Kawata | 271/208 |
| 6,682,237 | B2 | 1/2004 | Cocklin et al. | 400/624 |

FOREIGN PATENT DOCUMENTS

| | | |
|---|---|---|
| JP | 4-66429 | 3/1992 |
| JP | 11-109695 | 4/1999 |
| JP | 2000-211803 | 8/2000 |
| JP | 2000-2118094 | 8/2000 |
| JP | 2002-60113 | 2/2002 |

*Primary Examiner*—David H Bollinger
(74) *Attorney, Agent, or Firm*—Fitzpatrick, Cella, Harper & Scinto

(57) ABSTRACT

A feeding tray for feeding sheets from the left side thereof and a feeding tray for feeding sheets from the right side thereof are disposed on a multiple inserter, and selectively employing the feeding tray for feeding sheets from the left side thereof and the feeding tray for feeding sheets from the right side thereof allows reversal actions of sheets to be eliminated.

3 Claims, 8 Drawing Sheets

SHEET FEEDING DEVICE WITH PLURAL SHEET FEEDING MEANS FEEDING IN OPPOSITE DIRECTIONS TO SHEET POST-PROCESSING SYSTEM

This application is a divisional of U.S. patent application Ser. No. 10/660,583, filed on Sep. 12, 2003, now pending.

BACKGROUND OF THE INVENTION

1. Field of the Invention

The present invention relates to a sheet feeding device for feeding sheets, a sheet post-processing system, and an image formation system including the sheet feeding device.

2. Description of the Related Art

Conventionally, there have been image formation systems which control the insertion of sheets such as book covers, inside covers, back covers following bookbinding, and so forth, at such a timing that the sheets can be inserted in a predetermined output sequence without passing through an image formation apparatus and fixing means, in order to not deteriorate quality of printing images. Such an image formation system has been disclosed in Japanese Patent Laid-Open No. 2000-211803. The image formation system described in the aforementioned Japanese Patent Laid-Open comprises a multiple inserter 900 at an upper portion of a sheet post-processing device 500 connected to an image formation apparatus 10 as shown in FIG. 8, which can insert inserting sheets loaded in a tray 901 of the multiple inserter 900 at a timing which enables the sheets to be inserted in a predetermined output sequence. A bundle of sheets to be set are loaded into the tray 901 with the front side thereof facing up in order to prevent a mix-up between the front and back sides of inserting sheets caused by setting errors by the operator. The bundled sheets which form book covers and combining sheets loaded in the tray 901 are sequentially separated and transported to a transport path according to the post-processing mode of the sheet post-processing device 500 set from an unshown operating unit. In the event that the sort mode or the staple sort mode is set as a post-processing mode, the sheets need to be transported to a processing path 552 and sort path 554 with the front side thereof facing down. Accordingly, the inserting sheets in the tray 901 are transported from an inserter path 908 to the processing path 552 and sort path 554. On the other hand, in the event that the bookbinding mode is set as a post-processing mode, the sheets need to be transported to a bookbinding path 553 with the front side thereof facing the left side. Accordingly, the inserting sheets in the tray 901 are transported from the inserter path 908 to the processing path 552 and sort path 554, and temporally stopped there, and transported to the bookbinding path 553 in the reverse direction.

However, when the device is able to determine whether the inserting sheets are set faced up in the inserter tray 901 thereby preventing mix-ups between front and back sides of the inserting sheets due to setting errors by the operator, reversing operations of the inserting sheets need to be performed by either the sort mode, the staple sort mode, or the bookbinding mode set from the operating unit, resulting in marked reduction in productivity of the image formation system.

On the other hand, in the event the device is one in which the side of the inserting sheets to face up in the inserter tray 901 according to the selected post-processing mode is selectable, setting errors by the operator are brought about, resulting in mismatching of the sides of the inserting sheets.

SUMMARY OF THE INVENTION

The present invention has been made in light of the above-described problems, and accordingly, it is an object of the present invention to provide an image formation system capable of loading large amounts of inserting sheets into an inserter tray with the same side of the inserting sheets facing up without reducing productivity due to a post-processing mode set from an operating unit.

To this end, according to one aspect of the present invention, a sheet feeding device comprises: a plurality of sheet trays which are vertically disposed for storing sheets; a plurality of sheet feeding means for feeding sheets stored in the plurality of sheet trays; and a plurality of transport paths for transporting the sheets fed by the plurality of sheet feeding means, wherein a sheet feeding direction of sheets stored on at least one of the plurality of sheet trays is a direction opposite to a sheet feeding direction of sheets stored on another of the plurality of sheets trays.

According to another aspect of the present invention, a sheet feeding device comprising: a sheet tray for storing sheets; two sheet feeding means for feeding sheets stored on the sheet trays; and two transport paths for transporting sheets fed by the two sheet feeding means, wherein each of the two feeding means feeds sheets from the sheet tray in a direction opposite to the another.

Further objects, features and advantages of the present invention will become apparent from the following description of the preferred embodiments with reference to the attached drawings.

DESCRIPTION OF THE PREFERRED EMBODIMENTS

Embodiments according to the present invention will now be described in detail with reference to the drawings.

First Embodiment

Figure 1:
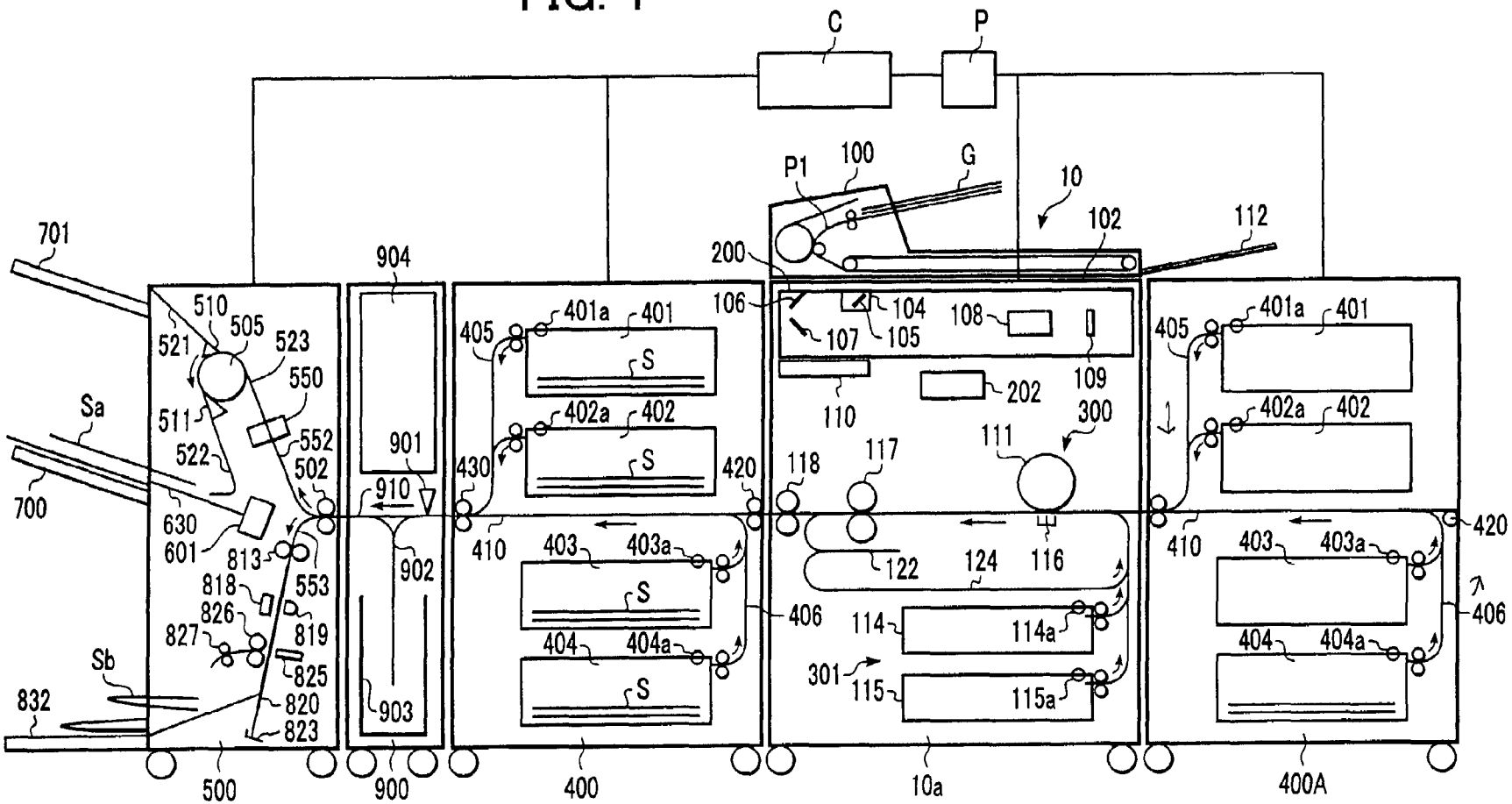
FIG. 1 is a diagram illustrating a schematic configuration of an image formation system according to a first embodiment of the present invention.

FIG. 1 is a diagram illustrating a schematic configuration of an image formation system according to a first embodiment of the present invention. In the drawing, reference numeral 10 denotes an image formation apparatus, 10*a* denotes an image formation apparatus main unit, 400 denotes a multiple inserter serving as a downstream side sheet feeding device disposed in parallel on the downstream side of the image formation apparatus 10, and 400A denotes a feeding deck serving as an upstream side sheet feeding device disposed in parallel on the upstream side of the image formation apparatus 10 for feeding sheets to the image formation apparatus 10. Reference numeral 500 denotes a sheet post-processing device disposed on the downstream side of the multiple inserter 400, and 900 denotes a reversing module serving as a sheet reversing device disposed between the sheet post-processing device 500 and the multiple inserter 400. Note that a sheet post-processing system according to the present invention is configured with the multiple inserter 400 and the sheet post-processing device 500.

The image formation apparatus 10 has an image reader 200 for reading original document images; an image formation unit 300 with a photosensitive drum 111, a transfer unit 116, a fixing unit 117 and so forth for image formation; and a sheet feeding mechanism 301 for feeding sheets stored in cassettes 114 and 115 to the image formation unit 300.

The image reader 200 feeds from the top page thereof one by one original documents G, which are set in an unshown original document tray in a face-up manner, and transports the original documents over a platen glass 102 from the left to right side thereof via a curved path P1, following which an original document feeding device 100 which belongs to the image reader 200 discharges the original documents into an externally provided discharge tray 112.

When original documents G pass over the platen glass 102 from the left to right side thereof by the original document feeding device 100 as described above, original document images are optically read out from a scanner unit 104 fixed and held at a predetermined position.

The optically read image is converted to image data by an image sensor 109, and is subjected to predetermined processing at an image signal control unit 202, following which the image data is input to an exposing control unit 110 of the image formation unit 300 as video signals.

Upon input of the video signals to the exposing control unit 110 of the image formation unit 300, the exposing control unit 110 of the image formation unit 300 modulates and outputs a laser beam based upon the input video signals. The laser beam is cast onto the photosensitive drum 111 while being scanned by an unshown polygon mirror, and an electrostatic latent image according to the scanned laser beam is formed on the photosensitive drum 111. Note that the exposing control unit 110 outputs a laser beam so that a normal image (not a mirror image) is formed at the time of reading fixed original documents.

The electrostatic latent image formed on the photosensitive drum 111 is visually formed as a developed image by a developing agent supplied from an unshown developer. Note that sheets are fed from the cassettes 114 and 115, or from a double-sided transport path 124 for transporting sheets to form images again on the back side of the image-formed surface at a timing synchronized to the irradiation start of a laser beam, and transported to between the photosensitive drum 111 and the transfer unit 116. Subsequently, the developed image formed on the photosensitive drum 111 is transferred onto the sheets by the transfer unit 116 upon the sheets passing between the photosensitive drum 111 and the transfer unit 116.

The sheets on which the developed image is transferred are transported to the fixing unit 117, and there the sheets are subjected to thermal pressing, whereby the developed image is fixed on the sheets. Subsequently, the sheets on which the developed image is fixed are discharged from the image formation unit 300 toward the multiple inserter 400 via an unshown flapper and a discharge roller 118.

In the event that the sheets are discharged from the image formation unit 300 in a state wherein the image formation side of the sheets, i.e., the front sides of the sheets following bookbinding, are faced down (referred to as "face-down" hereafter), the sheets passing through the fixing unit 117 are temporarily introduced into a reversing path 122 by switching actions of an unshown flapper, and following the trailing edges of the sheets passing through the flapper, the sheets are switched back, and discharged from the image formation unit 300 by the discharge roller 118, thereby performing reverse discharge.

Such reverse discharge is performed in the event of sequentially forming images from the top page such as in the event of forming read out images employing the original document feeding device 100, in the event of forming images output from a computer, or the like, so that the sheets following discharge are correctly collated.

In the event that double-sided recording in which images are formed on both sides of the sheets is set, after the sheets are introduced to the reversing path 122 by switching actions of the flapper, the sheets are transported to the double-sided transport path 124, and the control wherein the sheets introduced to the double-sided transport path 124 are again transported to the nip between the photosensitive drum 111 and the transfer unit 116 at the above-described timing is performed.

The multiple inserter 400 comprises large-size feeding trays 401 through 404 which are vertically disposed and capable of being drawn out in the direction of the near side of the apparatus, and a primary transport path 410 serving as sheet transporting means generally horizontally disposed at the center portion of the multiple inserter 400, and which receives sheets to be discharged from the image formation apparatus 10. The primary transport path 410 transports the received sheets to the downstream side reversing module 900 and the sheet post-processing device 500.

Moreover, the primary transport path 410 comprises a receiving roller 420 serving as a sheet introducing unit for receiving sheets from the image formation apparatus 10 and a discharge roller 430 serving as a sheet discharge unit for discharging sheets to the reversing module 900. The feeding trays 401 through 404 store special-purpose sheets such as bundled sheets of book covers, back covers, or combining sheets which are inserted between a book cover and a back cover, or the like. The inserting sheets stored in the feeding trays 401 through 404 are transported to the primary transport path 410. The multiple inserter 400 also has an inserter function to insert the inserting sheets stored in the feeding trays 401 through 404 to the desired position between the multiple sheets transported from the image formation apparatus 10.

The multiple inserter 400 is configured detachable as to the image formation apparatus 10 and the reversing module 900, thereby flexibly meeting the needs of various users such as creating an image formation system having no multiple inserter 400 for those users who do not require the inserter function.

Note that the multiple inserter 400 has the same configuration as the feeding deck 400A, so an arrangement may be made wherein the multiple inserter 400 is disposed upstream of the image formation apparatus 10 to serve as a feeding deck for feeding sheets to the image formation apparatus 10.

The feeding trays 401 through 404 sequentially store multiple sheets forming book covers, combining sheets, or the like (referred to as "multi-insert" hereafter), and the multiple inserter 400 sequentially transports the sheets for book covers, combining sheets, or the like to the reversing module 900 or the sheet post-processing device 500 via the primary path 410.

The inserting sheets set in the feeding trays 401 through 404 are sequentially fed from the uppermost sheet by feeding units 401*a* through 404*a* so as to be transported. Subsequently, the inserting sheets transported as described above are introduced to vertical transport paths 405 and 406 by an unshown extraction roller pair disposed in the downstream side of the feeding units 401*a* through 404*a*.

In the present embodiment, inserting sheets stored in the feeding trays 401 and 402 disposed at the upper portion of the primary transport path 410 are fed to the left side by the feeding units 401*a* and 402*a*, and those inserting sheets are transported to the transport path 405 vertically disposed. The transport path 405 interflows to the primary transport path 410, so the inserting sheets fed to the left side by the feeding units 401*a* and 402*a* are transported to the primary transport path 410 via the transport path 405. On the other hand, the inserting sheets stored in the feeding trays 403 and 404 disposed at the lower portion of the primary transport path 410 are fed to the right as viewed in FIG. 1 by the feeding units 403*a* and 404*a*, and transported to the transport path 406 vertically disposed. The transport path 406 interflows to the primary transport path 410, so the inserting sheets fed by the feeding units 403*a* and 404*a* are transported to the primary transport path 410 via the transport path 406.

Inserting sheets to be stored in the feeding trays 401 through 404 are special-purpose sheets demanded by the POD (Print On Demand) market, e.g., colored paper, book covers, color output paper, and the like, and in the event of setting such special-purpose sheets, the desired inserting sheets are loaded into the feeding trays 401 through 404 so that the front sides of the sheets following bookbinding are face up (referred to as "face-up" hereafter). Note that setting the inserting sheets in a constant direction improves workability of the users, and prevents setting errors.

The sheet post-processing device 500 sequentially brings in the discharged sheets from the image formation apparatus 10 via the primary transport path 410 of the multiple inserter 400, or the inserted sheets by the multiple inserter 400. Thereafter, various kinds of post-processing such as bundling for matching and bundling the brought-in sheets, stapling for stitching the end portions of bundled sheets with staples, punching for punching around the end portions of the brought-in sheets, sorting for sorting bundled sheets, non-sorted processing for not sorting the bundled sheets, bookbinding, and so forth are performed. Note that the post-processing modes such as the staple mode, sort mode, non-sort mode, bookbinding mode, or the like, are set by the operating unit P for performing display and operations.

This sheet post-processing device 500 includes an inlet roller pair 502 for introducing the transported sheets therein via the image formation apparatus 10 or the multiple inserter 400, and an unshown switching flapper for introducing the sheets to a processing path 552 or a bookbinding path 553 is disposed downstream the inlet roller pair 502.

In the event that the non-sort mode, the sort mode, or the staple mode is set as a post-processing mode by the operating unit P, which is used to set how to output sheets following bookbinding by the present image formation system, the sheets which are introduced to the processing path 552 by this switching flapper are transported toward a buffer roller 505 by an unshown transport roller pair. The buffer roller 505 is a roller capable of winding the received sheets over the circumference thereof so as to make the predetermined number of layers, and the sheets are wound over the circumference of this roller 505 by unshown multiple pressing rollers as necessary. Winding the sheets around the buffer roller 505 so as to make the predetermined number of layers secures processing time for sheets at an intermediate tray 630 described later. The wound sheets are transported by rotation of the buffer roller 505.

Switching flappers 510 and 511 are disposed near the circumferential transport path of the buffer roller 505. Here, the upstream switching flapper 510 is a flapper which peels the sheets wound around the buffer roller 505 from the buffer roller 505 so as to introduce the peeled sheets to a non-sort path 521 or a sort path 522. The downstream switching flapper 511 is a flapper which peels the sheets wound around the buffer roller 505 from the buffer roller 505 so as to introduce the peeled sheets to the sort path 522, or to introduce the sheets winding around the buffer roller 505 to a buffer path 523.

The sheets introduced to the non-sort path 521 by the upstream flapper 510 are discharged into a sampling tray 701 via an unshown discharge roller pair. Note that an unshown discharge sensor for detecting jamming sheets or the like is disposed along the non-sort path 521.

Furthermore, the sheets introduced to the sort path 522 by the upstream switching flapper 510 are loaded into the intermediate tray 630 by an unshown transport roller, following which the sheets are subjected to alignment, stapling which binds the loaded sheets in a bundle in the intermediate tray 630 by a stapler 601, or the like according to need, following which the sheets are discharged in a stack tray 700 having a vertically movable configuration as bundled sheets Sa by an unshown discharge roller.

Note that a punching unit 550 is disposed between the transport roller pair and the buffer roller 505, and a punched hole can be opened near the trailing edge of the transported sheets by operating this punching unit 550.

In the event that the saddle mode for performing bookbinding is set as a post-processing mode by the operating unit P, which sets how to output sheets following bookbinding by the present image formation system, the sheets are introduced to the bookbinding path 553 by the unshown switching flapper disposed downstream the inlet roller pair 502. Subsequently, the sheets introduced to the bookbinding path 553 are stored into a storing tray 820 by a transport roller pair 813, and furthermore, the sheets are transported until the tips of the sheets reach a movable sheet positioning member 823.

An unshown bookbinding inlet sensor is disposed upstream of the transport roller pair 813. Moreover, two pairs of staplers 818 are disposed on the way of the storing tray 820, and this stapler 818 is configured so as to bind the center of the bundled sheets in combination with an anvil 819 facing the staplers 818.

A folding roller pair 826 is disposed at a downstream position of the stapler 818, and a protruding member 825 is disposed at the opposite position of the folding roller pair 826. Upon this protruding member 825 being protruded toward the bundled sheets Sb stored in the storing tray 820, the bundled sheets Sb are protruded between the folding roller pair 826 so as to be folded, following which the bundled sheets are discharged to a saddle discharge tray 832 via a folding discharge roller 827. In the event of folding the bundled sheets Sb stapled by the stapler 818, the sheet positioning member 823 is lowered by a predetermined distance so that following stapling the staple position of the bundled sheets Sb matches the center position of the folding roller pair 826.

The reversing module 900 is disposed between the multiple inserter 400 and the sheet post-processing device 500, and also a generally horizontal path 910 and a reversing path 902 are disposed thereupon. Here, the generally horizontal path 910 is connected to the primary transport path 410 of the multiple inserter 400, for transporting sheets to the inlet roller pair 502 of the sheet post-processing device 500, and the reversing path 902 is a path which is branched from the generally horizontal path 910 and extends in a generally vertical direction. Note that each transport path of the feeding deck 400A, the image formation apparatus 10, the multiple inserter 400 and the reversing module 900 is disposed on the same generally horizontal surface.

The inserting sheets fed from the multiple inserter 400 are selectively transported to the reversing path 902 and reversed by switching the unshown switching flapper at the time of passing through the generally horizontal path 910.

As described above, enabling the inserting sheets fed from the multiple inserter 400 to be reversed by the reversing module 900, and also enabling the reversing module 900 to be separated from the multiple inserter 400, allows the multiple inserter 400 and the feeding deck 400A to be used in common. The vertical configuration of the reversing path 902 of the reversing module 900 reduces space for the entire system.

With the present embodiment, the reversing module 900 is independently disposed on the downstream side of the discharge roller 430 serving as a sheet discharge unit disposed on the primary transport path 410 of the multiple inserter 400. Furthermore, an arrangement may be made wherein reversing means for reversing the front and back sides of sheets are disposed on the upstream side of the discharge roller 430 in the primary transport path 410 of the multiple inserter 400, whereby the inserting sheets, fed from the feeding trays 401 through 404 of the multiple inserter 400 serving as the image formation system, can be reversed.

Next, the feeding deck 400A is disposed in parallel on the upstream side of the image formation apparatus 10, and the configuration thereof is the same as with that of the multiple inserter 400. That is to say, the feeding deck 400A comprises the multiple large-size feeding trays 401 through 404 serving as sheet storing means disposed in a vertical direction, the feeding units 401*a* through 404*a* serving as sheet feeding means for transporting sheets from the feeding trays 401 through 404, and the generally horizontal primary transport path 410 which is disposed at the center portion for receiving the sheets fed from the feeding trays 401 through 404 and also transporting the sheets to the image formation apparatus 10 on the downstream side.

Providing the feeding deck 400A having large-size feeding trays 401 through 404 allows for handling an increase of the kinds of sheets on which images are formed by the image formation unit 300, and an increase of feeding volume.

Providing the feeding deck 400A having the large-size feeding trays 401 through 404, and the multiple inserter 400 on the upstream and downstream sides of the image formation apparatus main unit 10*a* in parallel, allows for the various kinds of sheets required by the POD market to be handled, and allows interruption of system due to supplying of sheets to be prevented.

Here, the transporting processing of the sheets fed from the multiple inserter 400, and transporting processing of the sheets transported from the image formation apparatus 10 according to the selected post-processing mode by the operating unit P, will be described.

First, in the event of selecting the non-sort mode, the sort mode, or the staple mode, which are modes for transporting sheets to the processing path 552 which are selectable by the operating unit P, inserting sheets should be transported so as to be face down in the intermediate tray 630. Accordingly, in order to transport inserting sheets without reversing, the operator is prompted to set the inserting sheets fed from the multiple inserter 400 in the feeding trays 403 and 404 by the operating unit P as described later.

Subsequently, upon control unit C controlling the inserting sheets to be fed from the feeding trays 403 and 404, the inserting sheets from the multiple inserter 400 are loaded in a face-down state into the intermediate tray 630 without being reversed.

In the event of the saddle mode selection, the saddle mode being a mode to transport sheets to the bookbinding path 553 by the operating unit P, the inserting sheets should be transported so as to be in a face-up state in the storing tray 820. Accordingly, in the event of transporting the inserting sheets without reversing, the operator is prompted to set the inserting sheets to be fed from the multiple inserter 400 in the feeding trays 401 and 402 by the operating unit P as described later. Subsequently, upon control unit C controlling the inserting sheets to be fed from the feeding trays 401 and 402, the inserting sheets from the multiple inserter 400 are loaded in a face-up state into the storing tray 820 without being reversed.

Note that while the above description has been made with regard to a case of multiple inserting wherein multiple sets of special-purpose sheets such as book covers, combining sheets, and back covers for example, are loaded into the feeding trays 401 through 404 in this order, an arrangement may be made wherein book covers and back covers are loaded into separate feeding trays (referred to as "single insert" hereafter), prompting the operator to set the inserting sheets in a corresponding feeding tray according to the selected post-processing mode allows the sheets to be transported to the sheet post-processing device 500 without reversing the inserting sheets fed from the feeding trays 401 through 404 by the reversing module 900, so productivity of the image formation system can be improved.

Figure 3:
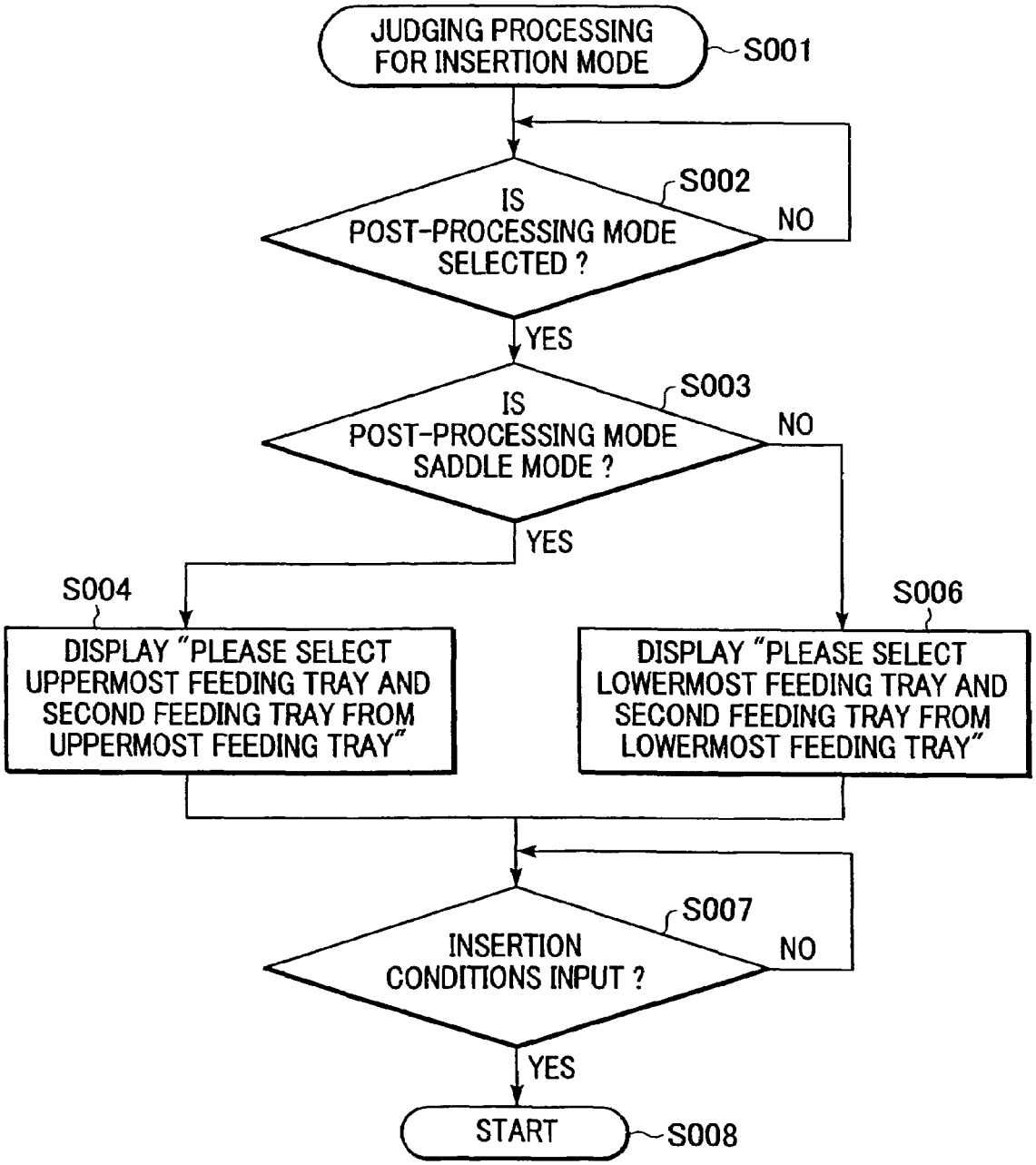
FIG. 3 is a flowchart with regard to selection of feeding trays in the event of selecting an insertion mode.

Next, control of the control unit C will be described with reference to a flowchart in FIG. 3, with regard to selection of an insertion mode, i.e., with regard to which of the feeding trays 401 and 402, or the feeding trays 403 and 404 are selected to feed sheets.

Judging processing for an insertion mode starts from Step 001 ("Step" will be abbreviated to "S" hereafter), and first, a post-processing mode is selected. In the event it is determined that a post-processing mode has been selected in S002, a judgment is made with regard to whether or not the selected post-processing mode is the saddle mode for transporting sheets to the bookbinding path 553 (S003). In the saddle mode, sheets should be transported in a face-up state to the bookbinding path 553. Thus, the inserting sheets are transported without being reversed in the sheet post-processing device, and the inserting sheets should be transported in a face-up state to the sheet post-processing device. Accordingly, in the event that the selected post-processing mode is the saddle mode, "Please select the uppermost feeding tray and the second feeding tray from the uppermost tray." is displayed by the operating unit P (S004) so that the operator selects the feeding trays 401 and 402 which can transport inserting sheets in a face-up state to the sheet post-processing device without reversal by the reversing module 900. In modes other than the saddle mode, i.e., the non-sort mode, the sort mode, or the staple mode, the sheets should be transported so that the sheets are in a face-down state in the intermediate tray 630. Since the inserting sheets are transported without being reversed in the sheet post-processing device, the inserting sheets should be transported in a face-down state to the sheet post-processing device. Accordingly, in the event that the selected post-processing mode is a mode other than the saddle mode, "Please select the lowermost feeding tray and the second feeding tray from the lowermost tray." is displayed by the operating unit P (S006) so that the operator selects the feeding trays 403 and 404 which can transport inserting sheets in a face-down state to the sheet post-processing device without reversal by the reversing module 900.

As described above, the control unit C controls selection of the feeding trays provided on the multiple inserter 400 to be used for feeding the inserting sheets, depending on whether the post-processing mode set at the sheet post-processing device 500 is a post-processing mode for transporting the inserting sheets to the sheet post-processing device 500 in a face-up state or in a face-down state, thereby eliminating reversal actions of the inserting sheets at the sheet post-processing device 500 and the reversing module 900, so there is no reduction in the productivity of the image formation system. Here, the post-processing mode for transporting the sheets in a face-up state to the sheet post-processing device 500 means the post-processing mode wherein the sheet post-processing device 500 can perform post-processing of the sheets without reversal actions in the event of transporting the sheets in a face-up state to the sheet post-processing device 500. The post-processing mode for transporting the sheets in a face-down state to the sheet post-processing device 500 means the post-processing mode wherein the sheet post-processing device 500 can perform post-processing of the sheets without reversal actions in the event of transporting the sheets in a face-down state to the sheet post-processing device 500.

The operator inputs insertion conditions such as whether the feeding tray is used for multiple insert or for single insert, and where the next inserting sheet is inserted in bundled sheets following selecting the feeding tray of the inserting sheets based upon the selected insertion mode, or the like. In the event of judging that insertion conditions have been input (S007), the image formation system starts operating (S008).

Next, description with regard to a mode requiring reversal actions of sheets by the reversing module 900 will be made.

As described above, the feeding direction of the inserting sheets stored in the feeding trays 401 and 402 of the multiple inserter 400 is the left side, so the inserting sheets are transported in a face-up state to the primary transport path 410 via the vertical transport path 405. On the other hand, the feeding direction of the inserting sheets stored in the feeding trays 403 and 404 is the right side, so the inserting sheets are U-turned via the vertical transport path 406, and transported in a face-down state to the primary transport path 410.

In the event of performing sorting, stapling and so forth in the sheet post-processing device 500, the inserting sheets should be transported in a face-down state to the processing path 552 since the sequence of pages is not matched unless face-down loading is performed on the intermediate tray 630 due to the image formation apparatus 10 processing the sheets from the top page. In the event of performing bookbinding with saddle-stitching, the sheets should be transported in a face-up state to the bookbinding path 553 in order to match the sequence of pages in folio.

Figure 2:
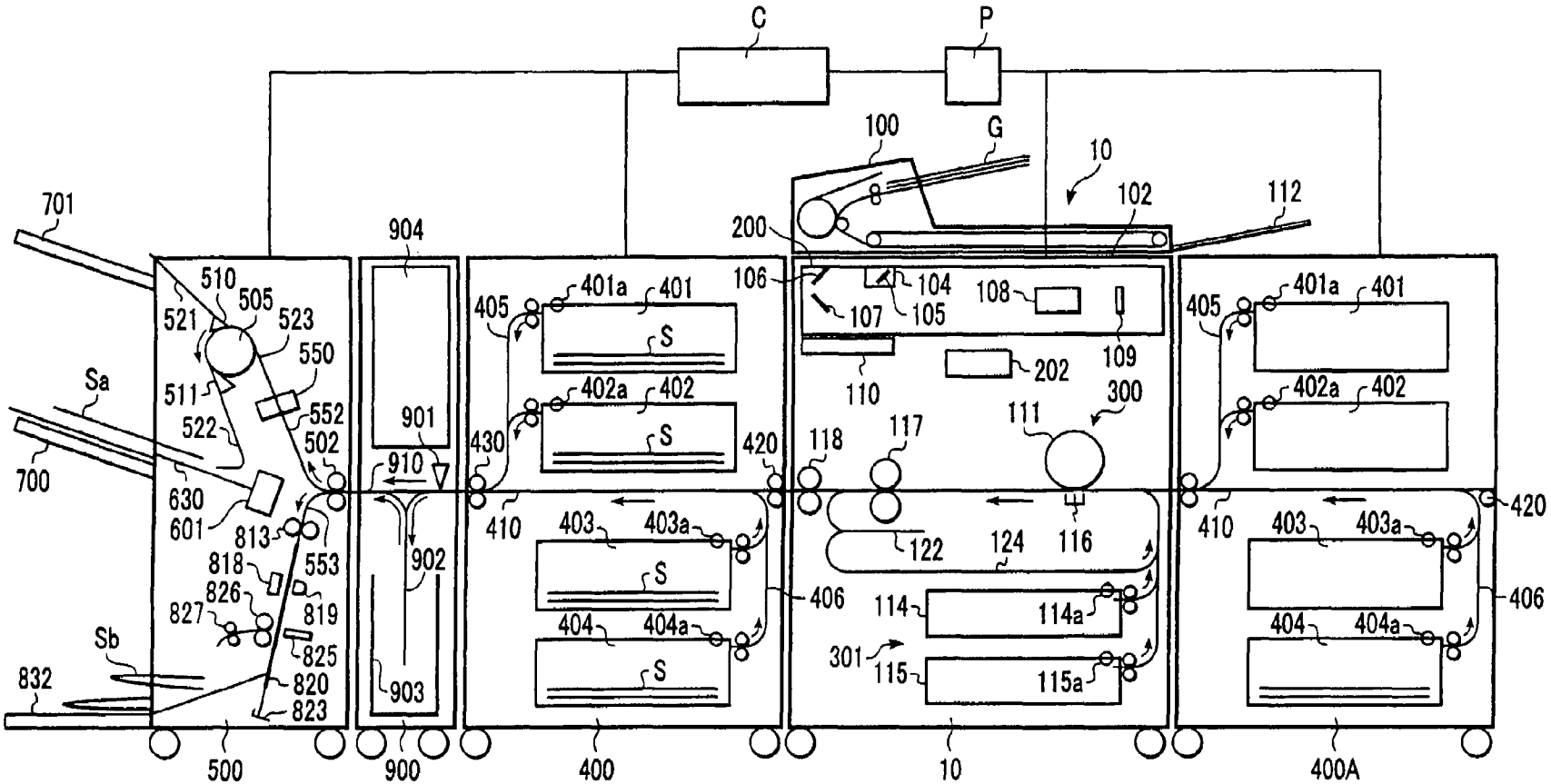
FIG. 2 is an explanatory diagram describing reversal actions of sheets by a reversing module provided on the image formation system according to the first embodiment of the present invention.

However, in the event of performing stapling for example, employing the inserting sheets stored in the feeding trays 403 and 404 allows the inserting sheets to be transported to the sheet post-processing device 500 without passing through the reversing path 902, and in the event of employing the feeding trays 401 and 402 regardless of multiple insert or single insert, only the inserting sheets of the feeding trays 401 and 402 are reversed by the reversing path 902 as shown by the arrow in FIG. 2 so as to be transported in a face-down state. In the saddle mode, wherein the sheets need to be transported face-up to the bookbinding path 553, when employing the inserting sheets stored in the feeding trays 403 and 404, the inserting sheets are reversed by the reversing path 902 so as to be transported in a face-up state to the bookbinding path 553 as shown in the arrow in FIG. 2.

When employing only the feeding trays requiring no reversal actions, control is simple. However, when employing three or more feeding trays as multiple insert, or when employing three or more feeding trays as single insert wherein one is for book covers, another is for combining sheets, and another is for back covers, the feeding trays requiring reversal actions should be selected. At this time, controlling the inserting sheets from the feeding trays requiring reversal actions so that the inserting sheets are reversed by the reversing module 900 allows the front and back sides of the inserting sheets to be matched.

Figure 4:
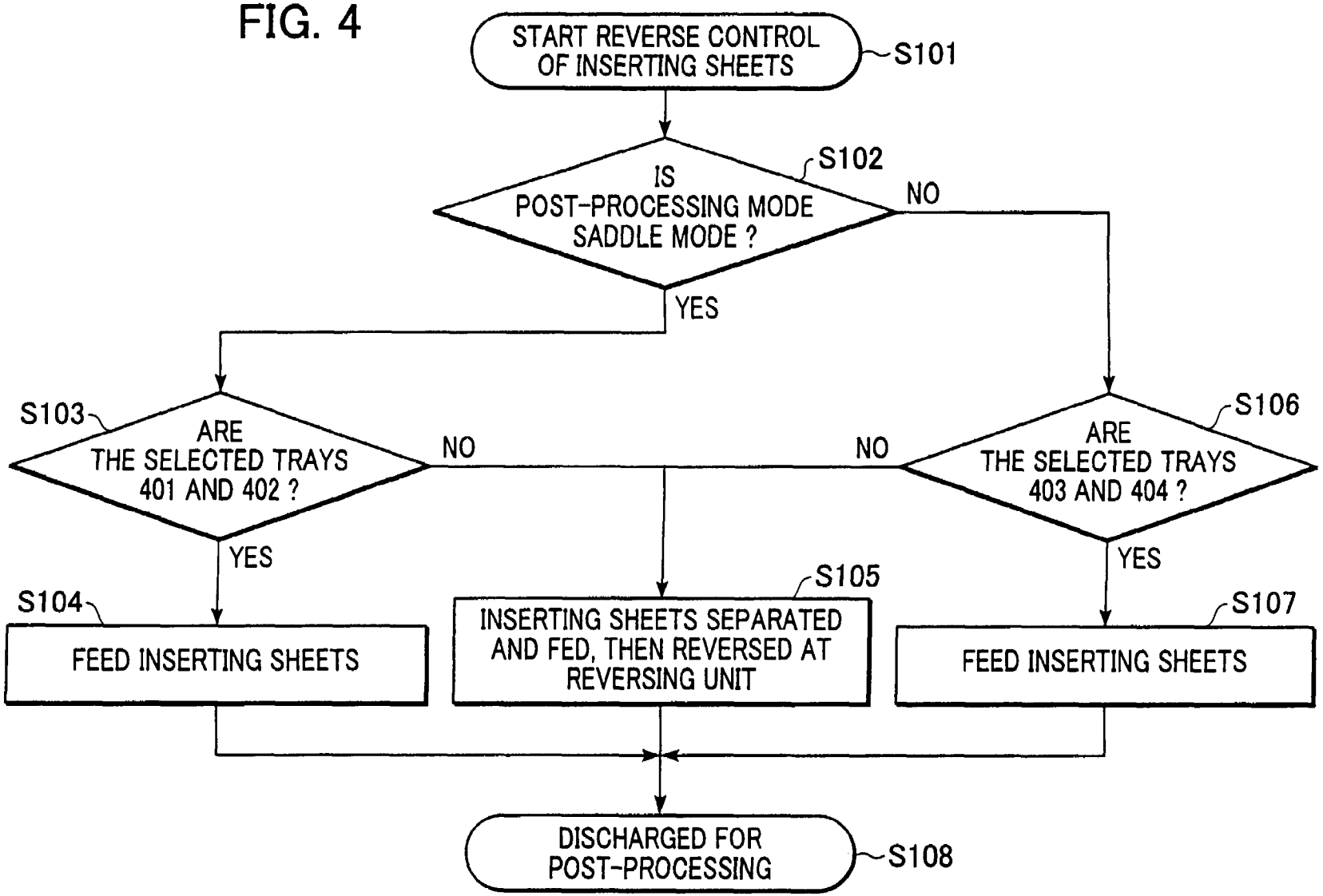
FIG. 4 is a flowchart relating to reversal actions in the event of selecting an insertion mode.

Description with regard to control of the control unit C for selecting use or disuse of reversal actions of the inserting sheets by the reversing module 900 will be made with reference to the flowchart in FIG. 4.

In S101, reversal control of the inserting sheets starts, and whether or not the post-processing mode is the saddle mode is determined in S102. If the selected post-processing mode is the saddle mode, it is then determined whether or not the feeding trays selected by the operator are the feeding trays 401 and 402 which can transport the inserting sheets without reversal (S103). If the selected feeding trays are trays 401 and 402 in S103, the inserting sheets are fed (S104), and discharged to the sheet post-processing device 500 without performing reversal actions by the reversing module 900 (S108). In the event that the feeding trays 401 and 402 are not selected in S103, the inserting sheets are fed, following which the inserting sheets are reversed by the reversing module 900 (S105), and subsequently, the inserting sheets are discharged to the sheet post-processing device 500 (S108).

In the event that the selected post-processing mode is determined to be a mode other than the saddle mode in S102, whether or not the feeding trays selected by the operator are the feeding trays 403 and 404 which can transport the inserting sheets without reverse is determined (S106). In the event that the feeding trays 403 and 404 are selected in S106, the inserting sheets are fed (S107), and the inserting sheets are discharged to the sheet post-processing device 500 (S108) without reversal by the reversing module 900. In the event that the feeding trays 403 and 404 are not selected in S106, the inserting sheets are fed, following which the inserting sheets are reversed by the reversing module 900 (S105), and subsequently, the inserting sheets are discharged to the sheet post-processing device 500 (S108).

While, with the above-described embodiment, the names of the recommended feeding trays have been displayed on the operating unit P according to the selected post-processing mode in order to prevent reversal actions of the inserting sheets, an arrangement may be made wherein the recommended feeding trays are displayed with highlighted characters in comparison with the not-recommended feeding tray, on the operating unit P. Also, the feeding trays requiring reversal actions may be selectively disabled on the operating unit P.

Figure 5:
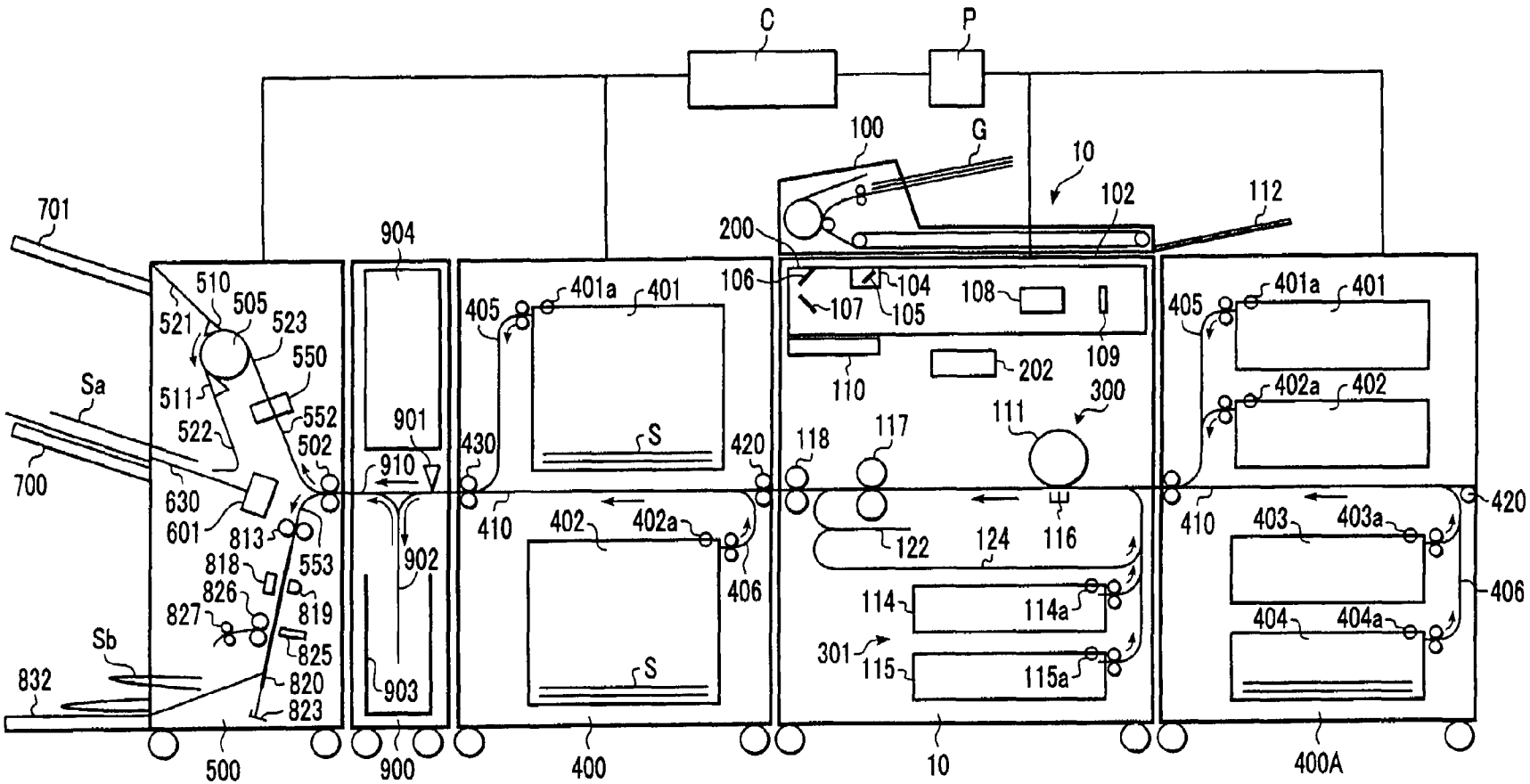
FIG. 5 is a diagram illustrating a schematic configuration of the image formation system according to a modification of the first embodiment of the present invention.

Moreover, with the above-described embodiment, the two feeding trays 401 and 402 are disposed at the upper side of the primary transport path 410 with a feeding direction in the left direction, and the two feeding trays 403 and 404 which are disposed at the lower side of the primary transport path 410 with a feeding direction in the right direction. Alternatively, an arrangement may be made wherein one feeding tray of which the feeding direction is the left direction and one feeding tray of which the feeding direction is the right direction are employed, thereby allowing the handling of a greater amount of inserting sheets as shown in FIG. 5. At this time, in the event that the post-processing mode is input from the operating unit P, the control unit C may automatically select one of the two feeding trays to feed the sheets wherein one has a left feeding direction, and the other has a right feeding direction. This prevents wide differences in processing time from occurring, since only one pair of feeding trays having opposed feeding directions allows mass processing but requires time for reversal actions of the inserting sheets in the event of employing a feeding tray requiring reversal actions.

With regard to a display method on the operating unit P, in the event of selecting the saddle mode as a post-processing mode, "Please set the inserting sheets in the uppermost feeding tray." may be displayed so the user feeds the inserting sheets from the displayed feeding tray only. Subsequently, the operator sets the inserting sheets in the displayed feeding trays so as to input an inserting place of the inserting sheets, and so forth following which post-processing starts.

Figure 6:
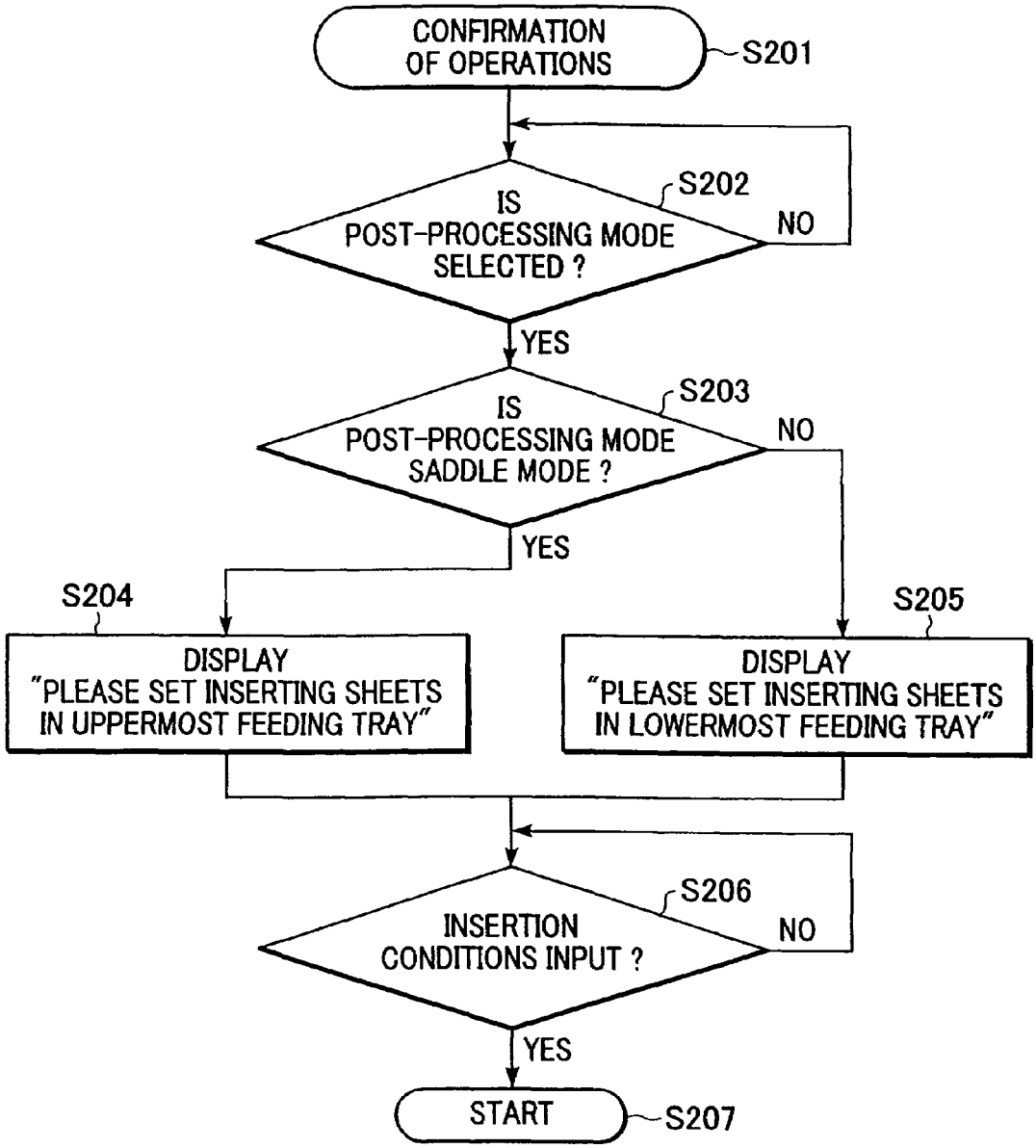
FIG. 6 is a flowchart relating to confirmation of operations in the event of automatic selection of feeding trays.

In the event of automatically selecting feeding trays, a confirming message if the inserting sheets are set in the selected feeding trays is displayed on the operating unit P, and post-processing starts. Description regarding control of the control unit C to confirm set actions of inserting sheets will be made with reference to a flowchart in FIG. 6 in the event of automatically selecting feeding trays.

Confirmation of set actions for inserting sheets starts in S201, and if it is determined that the post-processing mode has been selected in S202, a judgment is made with regard to whether or not the selected post-processing mode is the saddle mode (S203). In the event that the selected post-processing mode is the saddle mode, "Please set the inserting sheets in the uppermost feeding tray." is displayed by the operating unit P so that the operator is prompted to set the inserting sheets in the feeding tray 401, which can transport the inserting sheets without reversal (S204). In the event that the selected post-processing mode is other than the saddle mode, "Please set the inserting sheets in the lowermost feeding tray." is displayed by the operating unit P so that the operator is prompted to set the inserting sheets in the feeding tray 402 which can transport the inserting sheets without reverse (S205).

With the present embodiment, while an example has been described wherein a message to prompt the operator to set the inserting sheets in a feeding tray not requiring reversal is displayed, an arrangement may be made wherein the same kind of inserting sheets are set in feeding trays beforehand, and the control unit C automatically controls the inserting sheets to be fed from the feeding tray not requiring reversal. In this case, in the event of multiple insert, the same inserting sheets which are loaded in order of book covers, combining sheets, and back covers, for example, are set in any of the feeding trays 401, 402, 403 and 404. Also, in the event of single insert, the same kind of inserting sheets (e.g., book covers) are set in the feeding trays 401 and 403, and the same kind of inserting sheets (e.g., back covers) are set in the feeding trays 402 and 404.

The operator sets the inserting sheets in the recommended feeding tray, or confirms that the inserting sheets are set in the recommended feeding tray, and then inputs insertion conditions such as where the inserting sheet is inserted in the bundled sheets, or the like. Upon the operator inputting insertion conditions (S206), operation of the image formation system starts (S207).

Second Embodiment

Next, description of a second embodiment of the present invention will be made.

Figure 7:
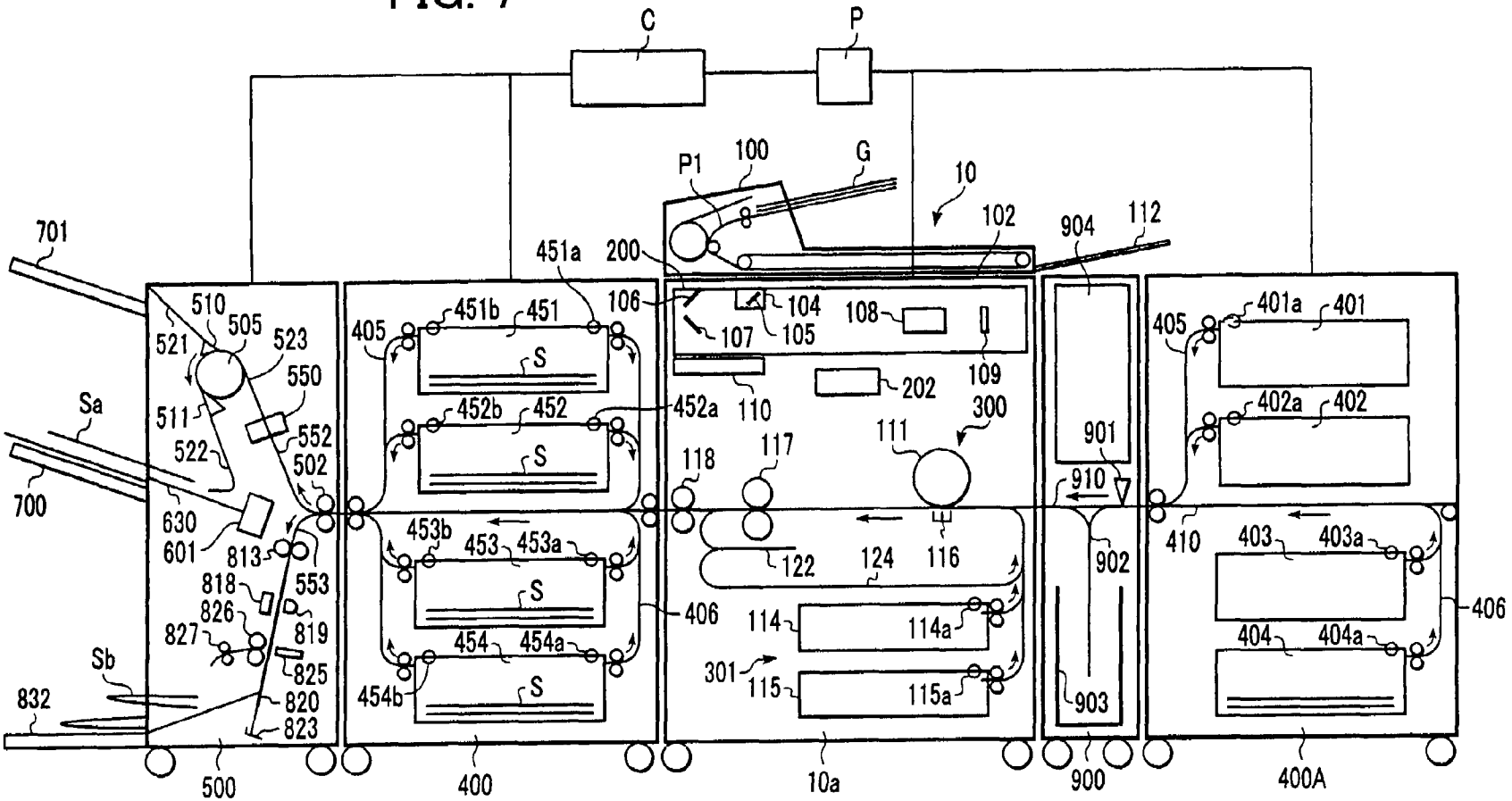
FIG. 7 is a diagram illustrating a schematic configuration of the image formation system according to a second embodiment of the present invention.
Figure 8:
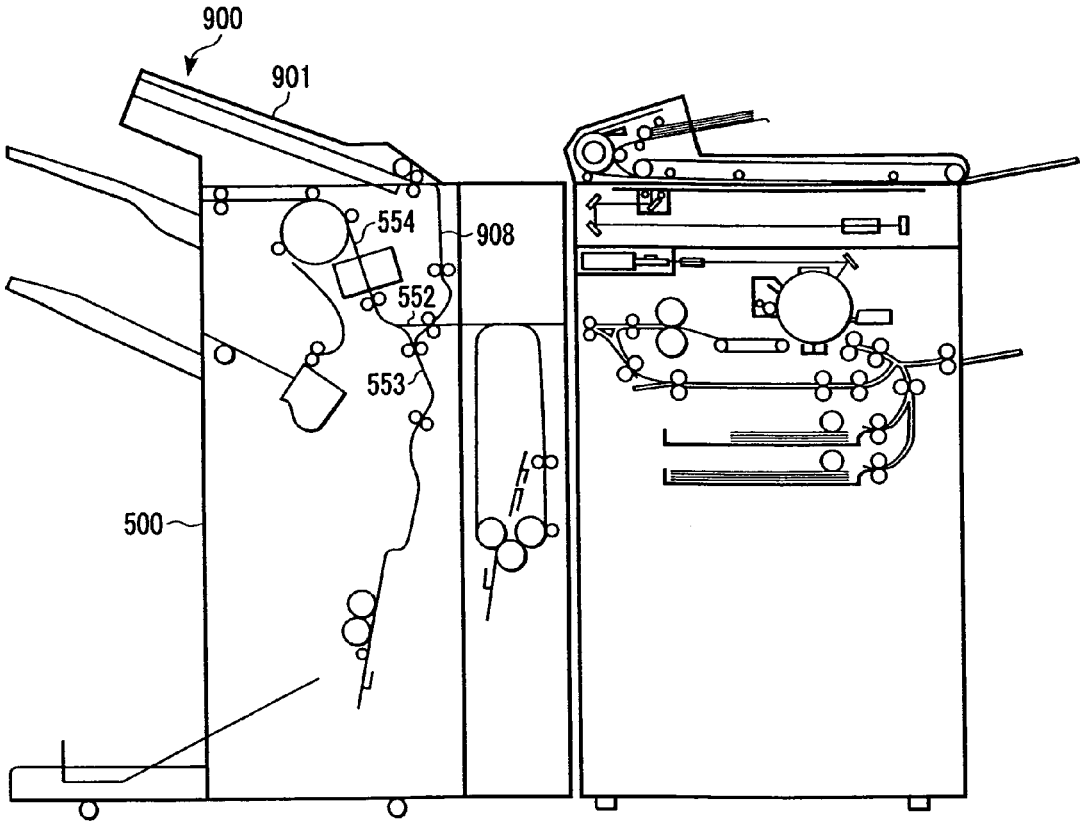
FIG. 8 is a diagram illustrating a configuration of a conventional image formation system.

FIG. 7 is a drawing illustrating a schematic configuration of an image formation system according to the second embodiment.

In the present embodiment, corresponding feeding units (e.g., 451*a* and 451*b*) are each disposed on opposite sides of feeding trays 451 through 454 of the multiple inserter 400 as shown in the drawing. The other components which are the same as those in the first embodiment are denoted with the same reference numerals, and description thereof will be omitted.

In the first embodiment, the feeding trays of the multiple inserter 400 to feed inserting sheets are selected based upon the selected post-processing mode. On the other hand, with the present embodiment, feeding units 451*a* through 454*a* and 451*b* through 454*b* are disposed on the both sides of the corresponding feeding trays 451 through 454, so regardless of which of the feeding trays are selected, the control unit C selectively employ the feeding units 451*a* through 454*a* and 451*b* through 454*b* disposed on the opposing sides of the corresponding feeding trays 451 through 454 according to the selected post-processing mode, and controls the inserting sheets stored in the feeding trays 451 through 454 to be fed. Selectively employing a pair of the feeding units 451*a* through 454*a* and 451*b* through 454*b* disposed on the feeding trays 451 through 454 allows the fed inserting sheets from the feeding trays 451 through 454 to be transported to the sheet post-processing device 500 without reversing the inserting sheets.

In the mode wherein the inserting sheets are transported in a face-down state to the intermediate tray 630, that is to say, in the sort mode and staple sort mode wherein inserting sheets are transported in a face-down state to the sheet post-processing device, the control unit C controls the inserting sheets to be fed by the feeding units 451*b* through 454*b* disposed on the right side of the corresponding feeding trays. Thus, the inserting sheets can be transported in a face-down state without being reversed. On the other hand, in the saddle mode wherein inserting sheets should be transported in a face-up state to the bookbinding path 553, the control unit C controls the inserting sheets to be fed by the feeding units 451*a* through 454*a* disposed on the left side of the corresponding feeding trays. Thus, the inserting sheets can be transported in a face-up state without being reversed. As described above, selecting from the feeding units 451*a* through 454*a* disposed on the right side of the corresponding feeding trays, and the feeding units 451*b* through 454*b* disposed on the left side of the corresponding feeding trays in order to feed the inserting sheets allows the post-processing of the sheets to be performed without reducing the productivity of the image formation system regardless the selected post-processing mode.

An arrangement may be made wherein a sheet feeding device having the same configuration as the multiple inserter 400 according to the present embodiment is disposed on the upstream side of the image formation apparatus 10, and is employed as a feeding deck for feeding sheets to the image formation apparatus.

As described above, according to the present invention, setting the inserting sheets in the same direction in the feeding trays allows post-processing of sheets to be performed without reducing the productivity and without reverse actions while preventing setting errors by the operator.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims.

What is claimed is:

1. A sheet processing system comprising:

a first feeding portion which feeds a sheet, a second feeding portion which feeds a sheet, wherein a sheet feeding direction of said first sheet feeding portion is a direction opposite to a sheet feeding direction of said second sheet feeding portion;

a transport path in which sheets fed by said first feeding portion and sheets fed by said second feeding portion are transported;

an image forming unit configured to form an image on a sheet;

a sheet processing device which is disposed downstream in a sheet transport direction of said transport path, said sheet processing device being able to perform a processing on sheets transported by said transport path and sheets on each of which an image is formed by said image forming unit in a first processing mode and a second processing mode a setting unit configured to set the first processing mode or the second processing mode in which said sheet processing device performs the processing on the sheets; and a selecting unit which selects said first feeding portion or said second feeding portion to feed a sheet according to the processing mode set by said setting unit, said selecting unit selecting said first feeding portion to feed a sheet when the first processing mode is selected by said selecting unit, and selects said second feeding portion to feed a sheet when the second processing mode is selected by said selecting unit, wherein, in the first processing mode, said sheet processing device performs the processing of the sheet without reversal of the sheet from said first feeding portion and, in the second processing mode, said sheet processing device performs the processing of the sheet without reversal of the sheet from said second feeding portion.

2. A sheet processing system according to claim 1, wherein said first feeding portion is disposed above said transport path, and wherein said second feeding portion is disposed below said transport path.

3. A sheet processing system according to claim 1, further comprising a display which displays a message to prompt to store sheet on the feeding portion selected by said selecting unit.

* * * * *